US005685079A

United States Patent [19]

Brothers et al.

[11] Patent Number: 5,685,079

[45] Date of Patent: Nov. 11, 1997

[54] LOCKING MECHANISM FOR A FOLDING KNIFE

[76] Inventors: Robert L. Brothers, 989 Philpott Rd., Colville, Wash. 99114; Bruce R. Taylor, P.O. Box 818, Sagle, Id. 83860

[21] Appl. No.: 717,760

[22] Filed: Sep. 23, 1996

[51] Int. Cl.[6] ..... B26B 1/02

[52] U.S. Cl. ..... 30/161; 30/155

[58] Field of Search ..... 30/155, 157, 158, 30/160, 161, 337

[56] References Cited

U.S. PATENT DOCUMENTS

| | | | |
|---|---|---|---|
| 364,414 | 6/1887 | Hollweg | 30/160 |
| 727,724 | 5/1903 | Weil | 30/161 |
| 1,782,901 | 11/1930 | Kassel | 30/161 |
| 4,120,088 | 10/1978 | Phelps | 30/160 |
| 4,177,560 | 12/1979 | Sakurai | 30/160 |
| 4,240,201 | 12/1980 | Sawby | 30/161 |
| 4,425,709 | 1/1984 | Quenzi | 30/151 |
| 4,604,803 | 8/1986 | Sawby | 30/161 |
| 4,979,301 | 12/1990 | Walker | 30/161 |
| 5,093,995 | 3/1992 | Jan | 30/161 |
| 5,331,741 | 7/1994 | Taylor | 30/158 |

FOREIGN PATENT DOCUMENTS 38553 5/1886 Germany .

*Primary Examiner*—Hwei-Siu Payer

*Attorney, Agent, or Firm*—David S. Thompson

[57] ABSTRACT

A folding knife is disclosed having a unique locking mechanism which prevents the blade from being closed when the knife is in use. The locking mechanism provides a rolling lock carried by the knife mechanism having a lever that is movable between two positions. In an unlocked position, the blade may be rotated between the extended and closed positions. With the lever in the locked position, the blade is held in the extended position. The blade provides a base having a cam surface and a notch in that surface. The rolling lock provides a cylindrical body having a notch. When the rolling lock lever is in the unlocked position and the blade is extended, the notch in the cylindrical body of the rolling lock occupies the same space as the notch in the cam surface of the blade, allowing the cam surface of the base of the blade to rotate through the notch in the rolling lock. When the rolling lock lever is in the locked position, the notch in the cylindrical body of the rolling lock is rotated away from the blade, and the cylindrical body of the rolling lock is present in the notch in the blade. As a result, the blade will not pivot unless sufficient force is applied to the blade to shear the cylindrical body of the rolling lock.

7 Claims, 6 Drawing Sheets

80
83
82
88
86
89
87
81
85

54
59
60
82
84
55
61
80

82
84
80
85
81

102
104
106
103
107

75
77
76
73

79b
78
79a 71
50
41

71
49
43
50
41

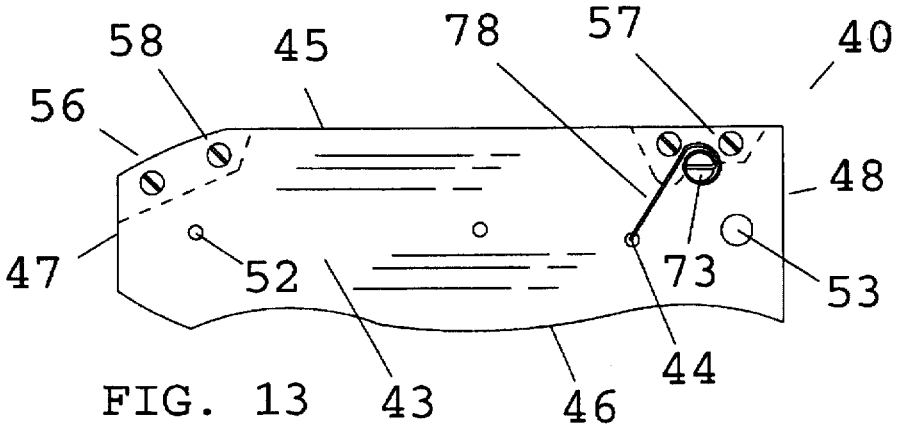
FIG. 13
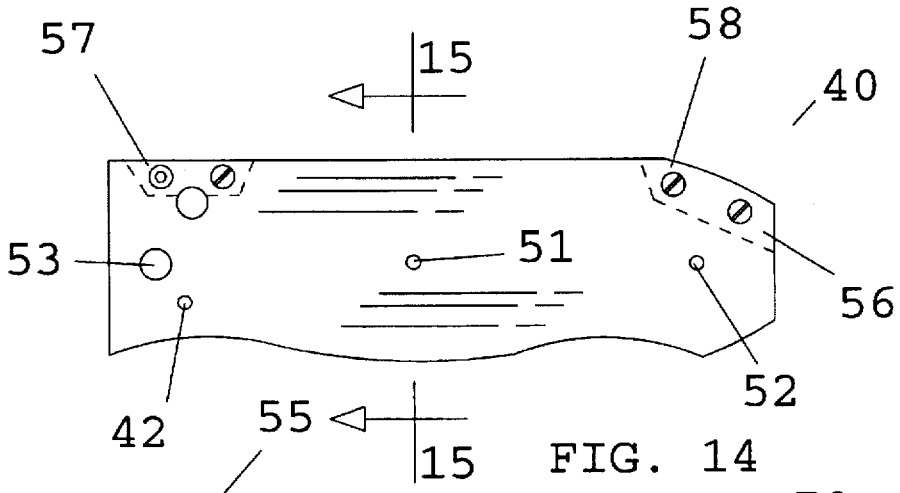
FIG. 14
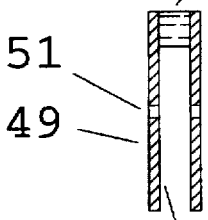
FIG. 15
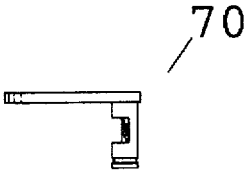
FIG. 16
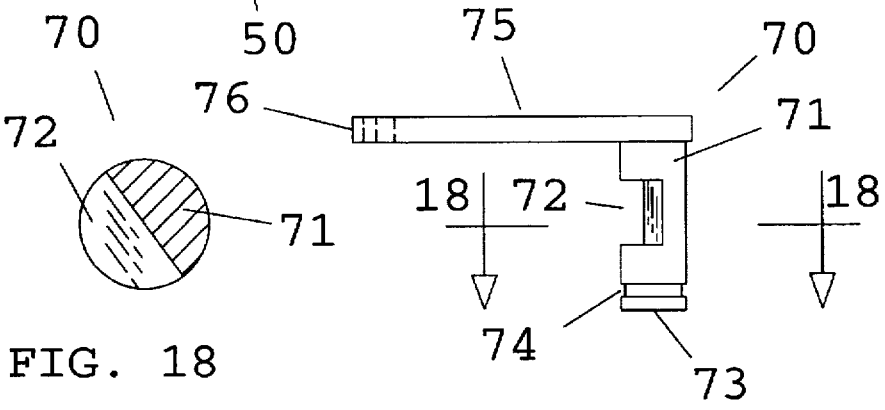
FIG. 18
FIG. 17

LOCKING MECHANISM FOR A FOLDING KNIFE

CROSS-REFERENCES

There are no applications related to this application filed in this or any foreign country.

BACKGROUND

Folding knives of having a threshold quality level typically provide structures that prevent the blade of the knife from closing unexpectedly. Two types of such structures include the lock back and the liner lock. The lock back structure provides a lever having a hook or tooth that engages the blade. The liner lock provides a liner of sheet metal that snaps into place when the blade is opened, thereby preventing closure until the liner is manually moved out of the way of the blade.

Both of the above methods, and other less popular methods, have inherent flaws that may cause a lock failure, which could cause injury to the user if the blade rapidly closes.

What is needed is structure that will securely lock the blade in the extended position when in use, and that may be easily adjusted between the locked and unlocked positions. The lock must be constructed in a manner that will not jam. It is also particularly important that the lock must not fail (resulting in a closure of the blade) even if substantial force is put against the back of the blade.

For the foregoing reasons, there is a need for a lock mechanism for a folding knife that is easily operated, will not jam, and that can resist substantial force without failure.

LOCKING MECHANISM FOR A FOLDING KNIFE SUMMARY

The present invention is directed to an apparatus that satisfies the above needs. A novel folding knife is provided that discloses a rolling lock structure that prevents the blade from being unintentionally closed.

A knife having the rolling lock mechanism of the present invention provides some or all of the following structural components:

(a) A knife mechanism. The knife mechanism supports a pivoting blade and is covered by left and fight handle shells. The knife mechanism provides left and right plates separated by front and rear spacers. The region between the plates provides a storage area for the blade when it is in the closed position. Each plate provides a hole for supporting a pivot bolt, which in turn supports the blade, and a hole to support the cylindrical body of the rolling lock mechanism. Threaded holes are provided which allow the left and right handle shells to be attached. The left plate additionally provides a hole for a blade latch mechanism, which provides an easily overcome bias keeping the blade in the closed position. The right plate additionally provides a hole to anchor a spiral spring which biases the rolling lock into the locked position.

(b) A blade is rotatable about the pivot bolt carried by the holes in the knife mechanism, between an extended or operative position and a retracted storage position where the blade is protected by the left and right plates of the knife mechanism. The blade provides a cutting edge and a base having a pivoting hole and a rounded cam surface. A notch in the cam surface is alternately engaged or released by the rolling lock mechanism.

(c) A rolling lock mechanism is carried by holes in the plates of the knife mechanism and is rotatable by means of a lever between a locked position and a released position. The rolling lock mechanism provides a cylindrical body having a notch in one side. The rolling lock is biased by means of a spiral spring into the locked position, wherein the cylindrical body is carried by the notch in the cam of the base of the blade. Movement of the lever easily overcomes the spring and rotates the cylindrical body of the rolling lock to a position where it does not engage the notch of the cam of the blade. In this position, the notch in the cylindrical body is occupies the same space as the notch in the cam of the blade, thereby allowing the base of the blade to rotate through the notch in the cylindrical body of the rolling lock mechanism.

(d) Left and fight handle shells are attached by means of screws to threaded holes in the knife mechanism. The left handle shell provides a hollow inside area within which the lever of the rolling lock travels between the locked and released positions. The right handle shell provides a hollow inside area within which the spiral spring biasing the rolling lock is housed.

It is therefore a primary advantage of the present invention to provide a novel locking mechanism for a folding knife that is stronger than known locking mechanisms, and will therefore better protect the user against unintentional blade closure.

Another advantage of the present invention is to provide a novel locking mechanism for a folding knife that is easily operated.

A still further advantage of the present invention is to provide a locking mechanism for a folding knife that is lever operated, and therefore more easily operated than presently known locking mechanisms.

A still further advantage of the present invention is to provide a locking mechanism for a folding knife that is less costly to manufacture than presently known locking mechanisms.

BRIEF DESCRIPTION OF THE DRAWINGS

These and other features, aspects, and advantages of the present invention will become better understood with regard to the following description, appended claims, and accompanying drawings where:

FIG. 13 is a view of the right side of the mechanism, having the spiral spring attached to the rolling lock;

FIG. 14 is a view of the left side of the mechanism;

FIG. 15 is a cross-sectional view of the mechanism along the 15—15 lines of FIG. 14;

FIG. 16 is a view of the rolling lock sized approximately to scale with FIGS. 1–4;

FIG. 17 is an enlarged view of the rolling lock of FIG. 16 to better show detail;

FIG. 18 is a cross-sectional view of the rolling lock of FIG. 17 along the 18—18 lines;

DESCRIPTION

Figures 1, 2, 3, 4, 5, 6, 7, 8:
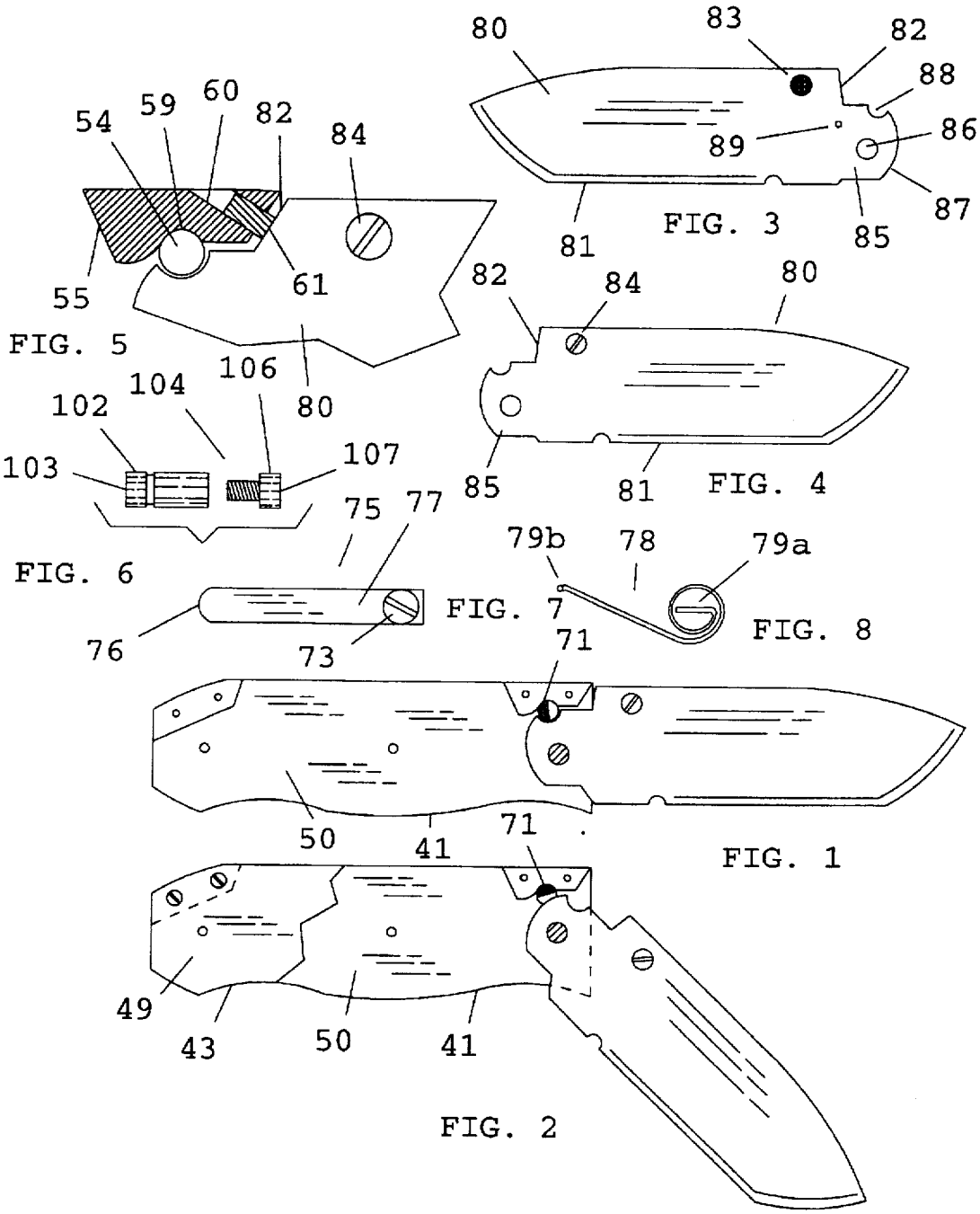
FIG. 1 is a side view of a version of the folding knife of the invention, having the right side of the mechanism removed to expose the rolling lock, which is shown in cross-section, in the locked position and having the blade extended.
FIG. 2 is a side view of the knife of FIG. 1, having a portion of the right side of the mechanism removed and having the blade partly retracted, with the rolling lock shown in cross-section and in the unlocked position.
FIG. 3 is a left side view of the blade of the knife of FIG. 1.
FIG. 4 is a right side view of the blade of the knife of FIG. 1.
FIG. 5 is an enlarged cross-sectional view of the forward spacer and the rear edge of the blade showing the adjustment bolt.
FIG. 6 is an enlarged view of the blade pivot bolt, removed from the knife of FIG. 1.
FIG. 7 is a top view of the rolling lock removed from the knife of FIG. 1.
FIG. 8 is top view of the spring used to bias the rolling lock to the locked position.

Referring in particular to FIGS. 1–2 and 9–12, a folding knife constructed in accordance with the principles of the invention is seen. A knife mechanism 40 supports a folding blade 80 by means of a pivot bolt 100. The folding knife provides a unique rolling lock 70 that safely locks the blade in the open position when it is fully extended. The rolling lock may be unlocked by means of a lever 75 against the bias of a spiral spring 78, thereby allowing the blade to be closed for storage within the knife mechanism 40. A left handle shell 20 is carried by the knife mechanism and provides a recessed surface 27 which defines a cavity between the left shell and the knife mechanism through which the lever travels. A right handle shell 30 similarly defines a cavity between the right shell and the knife mechanism which carries a spiral spring which biases the rolling lock mechanism in the locked position.

Referring in particular to FIGS. 13 and 14, a version of the knife mechanism 40 of the invention is seen. The knife mechanism generally comprises a left plate 41 and a right plate 43 separated by a front spacer 55 and a rear spacer 56. The left plate 41 is seen particularly in FIG. 14, while the right plate is seen in FIG. 13. As seen in FIG. 15, the two plates are held in a parallel relationship approximately 3/16" apart. With exceptions to be noted, the plates 41, 43 are mirror images of each other. Both plates provides a top edge 45, a bottom edge 46, a front edge 48 and a rear edge 47. Each plate additionally provides an outside surface 49 and an inside surface 50. A threaded middle hole 51 and a threaded rear hole 52 allow the left and right handle shells to be installed. A pivot hole 53 for the blade pivot bolt 100 and a hole 54 for the rolling lock 70 are also common to both plates 41, 43. The left plate 41 provides a blade latch mechanism hole 42, as seen in FIG. 14. The right plate 43 provides a spiral spring retainer hole 44, which functions as one possible attachment means for attaching the spiral spring 78 to the right plate of the knife mechanism. The spiral spring 78 is the preferred means for biasing the rolling lock in the locked position. However, other known attachment means such as solder or welding would be workable alternatives.

As seen in FIGS. 1–2 and 9–14, a front spacer 55 and a rear spacer 56 separate the plates 41, 43 of the knife mechanism 40. Each spacer provides left and right pairs of threaded screw holes, allowing front pairs of screws 57 and rear pairs of screws 58 to attach both plates to both spacers. Alternatively, other fastening means may be used, although screws are the preferred fasteners. The front spacer 55 provides a half-round recess 59 for the rolling lock, adjacent to the hole 54 for the rolling lock.

Referring to FIG. 5, a version of the adjustment bolt of the invention is seen. The front spacer 55 is shown in cross-section to reveal a threaded hole 60 carrying an adjustment bolt 61, which may be advanced to contact the rear edge 82 of the blade. By advancing or retracting the bolt 61, the exact degree to which the blade may be opened may be controlled.

Referring to FIGS. 3 and 4, a version of the blade 80 of the invention is seen. A cutting edge 81 extends along the bottom and front of the blade. A rear edge 82 contacts the front spacer 55 and adjustment bolt 61. A release handle 83, attached by means of release handle screw 84 or other fastening means, is a small peg which allows the user to more easily open the blade from the closed position. A base 85 provides a pivot bolt hole 86 which connects the blade to the knife mechanism by means of pivot bolt 100. The base further provides a rounded cam surface 87 having a rounded notch 88, having a curvature similar to the cylindrical body 71 of the rolling lock 70. Notch 88 is instrumental in engaging the rolling lock 70, and in preventing unplanned blade closure. A dimple 89 in the base of the blade engages the blade latch mechanism 110, as will be seen, providing a slight frictional inhibition to opening the blade when closed.

Referring to FIG. 6, a version of the pivot bolt 100 of the invention is seen. The pivot bolt is carried by pivot bolt holes 53 in left and right plates 41, 43 of the knife mechanism 40, and in turn pivotally carries the blade 80 by means of hole 86 in base 85. An elongate nut having internal threads engages a short bolt 104 having external threads. The elongate nut provides a knurled end 102 for hand tightening, and a wrench socket 103 for additional tightening. The short bolt provides a similar knurled end 106 and wrench socket 107.

Referring to FIGS. 7–8 and 16–18, a version of the rolling lock of the invention is seen. The cylindrical body 71 of the rolling lock may engage notch 88 in the cam surface 87 of the blade, thereby locking the blade in the open position. Similarly, the notch 72 in the cylindrical body 71 may allow the cam surface 87 of the blade to pass, thereby allowing the blade to be closed.

Referring in particular to the enlarged view of FIG. 17, it is seen that the rolling lock mechanism 70 provides a generally cylindrical body 71 having a notch 72. The cylindrical body is carried by holes 54 in left and right plates 41, 43 in a manner that allows the cylindrical body to pivot. An end surface having a retainer slot 73 is best seen in FIG. 7. An annular groove 74 is best seen in FIG. 17. In the preferred embodiment, the attachment means to attach the spiral spring 78 to the rolling lock comprises the slot 73 and the groove 74. However, other known attachment means such as solder or welding would be workable alternatives. A lever 75 provides a body having a flat surface 77 and a textured end 76. The lever 75 allows the user to rotate the rolling lock between an unlocked position wherein the cam surface 87 of the base 85 of the blade 80 passes through the notch 72 in the cylindrical body 71 of the rolling lock 70, and a locked position wherein the cylindrical body is in the notch 88 of the base 85 of the blade 80, preventing movement of the blade.

In the preferred embodiment, the lock biasing means for biasing the rolling lock mechanism 70 into the locked position include the spiral spring 78 is seen in FIG. 8. However, other biasing components, such as elastic, may be substituted. The spiral spring tends to bias the rolling lock 70 into the locked position, preventing movement of the blade. The spiral spring provides a first coiled end **79*a* and a slightly hooked second end 79*b*. The coiled end 79*a* is carried by the annular groove 74 and slot 73 of the end surface of the cylindrical body of the rolling lock. The hooked second end 79*b* is inserted into the spring retainer hole 44 in the right plate 43 of the knife mechanism 40. Viewed from the perspective of FIG. 1, the spiral spring tends to bias the rolling lock in the counter clockwise direction, to the position seen in FIG. 1**, where the blade of the knife is locked in place by the rolling lock.

Figure 32:
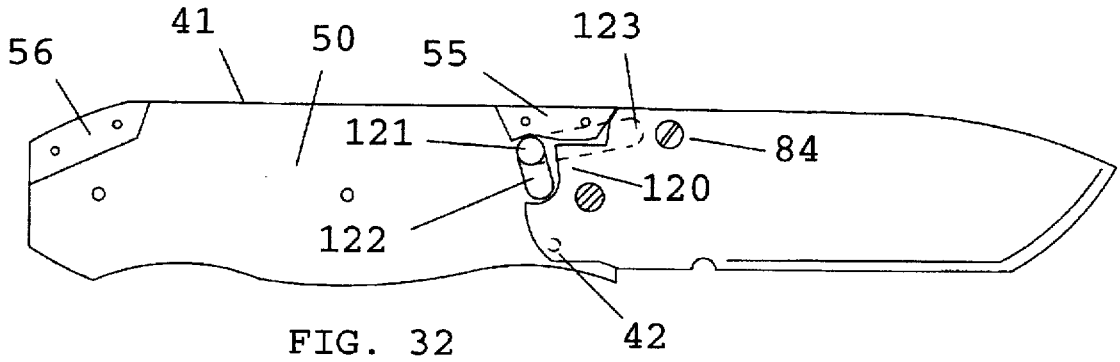
FIG. 32 is a side view of the knife of FIG. 1 having a second version of the rolling lock, showing the lock in the locked position, and having the right side of the mechanism removed for clarity, and showing in dotted outline the blade latch mechanism hole in the left side of the knife mechanism.
Figure 33:
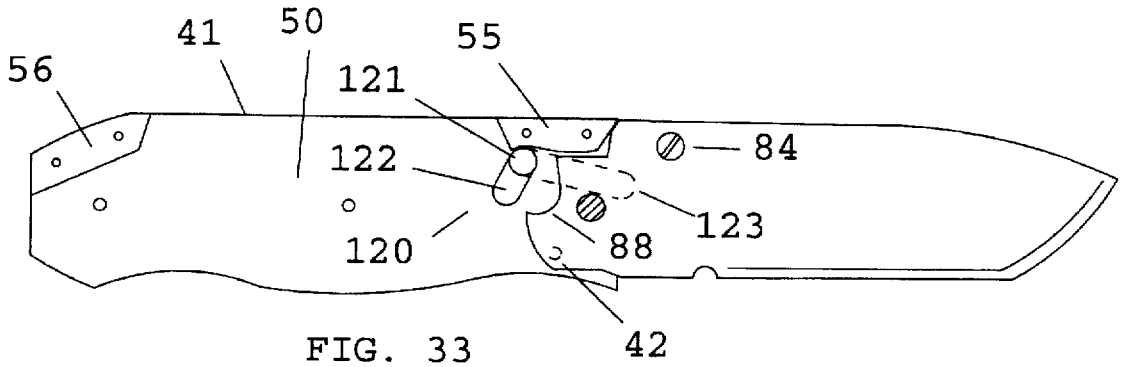
FIG. 33 is a view of the knife of FIG. 32, having the rolling lock in the unlocked position.
Figure 34:
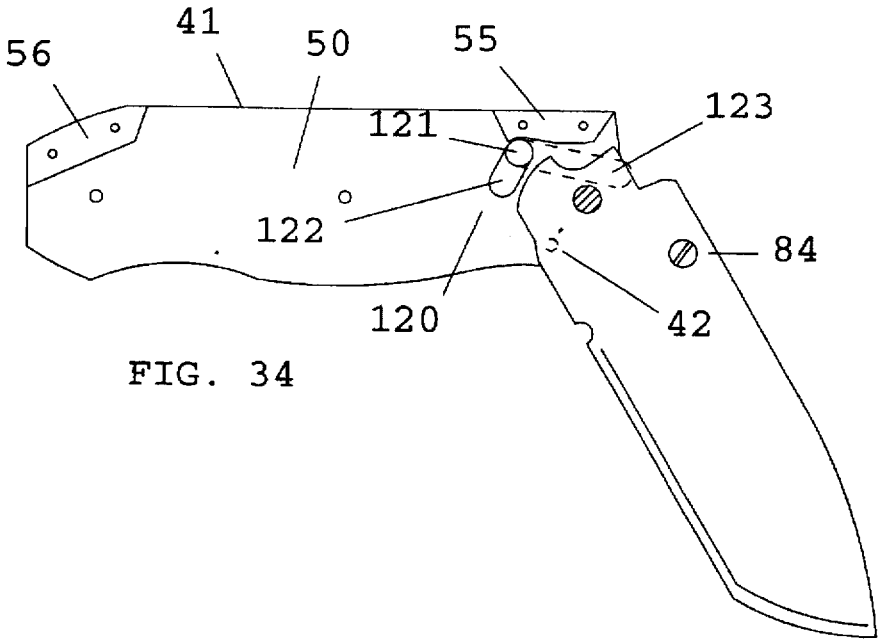
FIG. 34 is a view of the knife of FIG. 32 having the blade partially open and the lever of the rolling lock in a position indicating that the rolling lock is in the unlocked state.

Alternate versions of the rolling lock are possible. For example, as seen in FIGS. 32–34, a rolling lock 120 is rotatably carried by the knife mechanism 40. The rolling lock 120 provides a cylindrical body 121, a locking tooth 122 and a lever 123. The cylindrical body 121 is carried by two holes in the knife mechanism, and allows the rolling lock 120 to be rotated from a locked position, seen in FIG. 32, to an unlocked position seen in FIGS. 33, 34, by any of the below rotating means. The rotating means illustrated in FIGS. 32–34 is the lever 123. As the rolling lock 120 is moved from the locked to the unlocked position, a locking tooth 122 is moved from a position engaging the notch 88 in the blade 80 to a position which allows the blade to rotate freely. The shape of the locking tooth 122 and the notch 88 may be rounded, as illustrated, or rectangular if desired.

Figure 26:
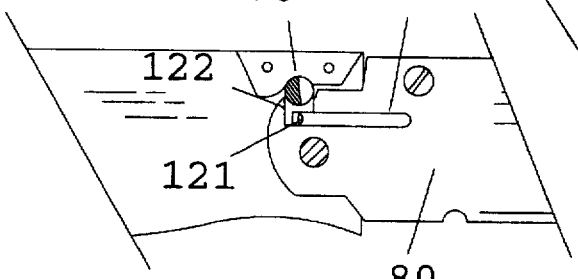
FIG. 26 is a side view of a version of the invention having front a pushbutton replacing the lever of the rolling lock mechanism.

As seen in FIGS. 26–31, several additional versions of the invention provide alternate structures which rotate the cylindrical body 71 having a notch 72 of the rolling lock mechanism 70. Referring to FIG. 26, a front pushbutton version of the invention provides a pushbutton 120 that extends forwardly, parallel and adjacent to the knife blade. Movement of the pushbutton, in the direction of the length of the knife, causes lever 122 to rotate about cylindrical body 71. Rotation of cylindrical body 71 locks and unlocks the blade, as seen above. Spiral spring 78 biases the blade in the open position. The pushbutton 120 is attached to a lever 122 by a pivot 121, such as a pin traveling in a slot. The slot allows the linear motion of the pushbutton 120 to be translated into a circular motion of the lever 122. Rotation of the lever 122 operates the rolling lock mechanism, as seen above.

Figure 27:
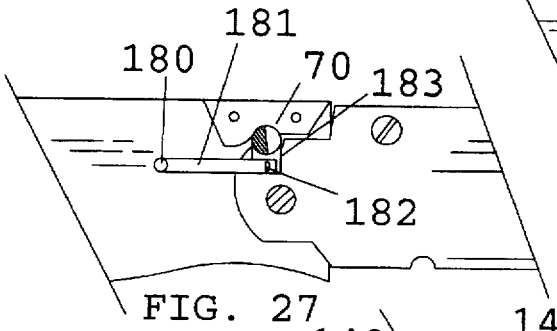
FIG. 27 is a side view of a version of the invention having a sliding pushbutton replacing the lever of the rolling lock mechanism.

Referring to FIG. 27, an alternate pushbutton structure may be provided to drive the rolling lock. A rearwardly directed pushbutton 180 having a support shaft 181 is movable in the direction of the length of the knife. The pushbutton 180 is accessible through a lengthwise slot in the right or left handle shell (not shown), allowing the pushbutton 180 to side forwardly and backwardly. Movement of the pushbutton shaft 181 drives the lever 183 by means of a pivot 182, again comprising a pin and slot. Rotation of the lever 183 operates the rolling lock mechanism, as seen above.

Figure 29:
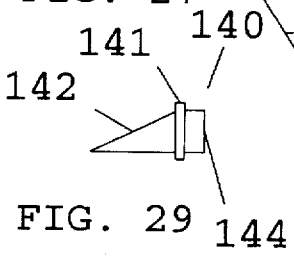
FIG. 29 is a side view of the side pushbutton of FIG. 28.
Figure 28:
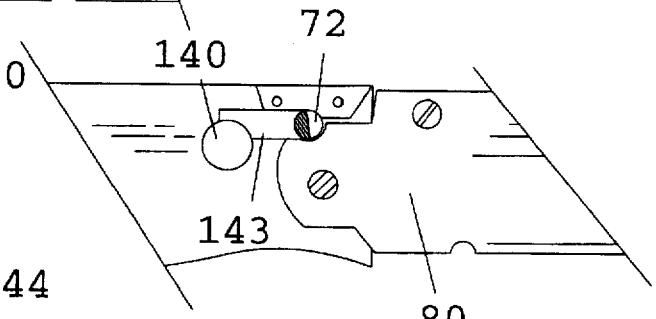
FIG. 28 is a side view of a version of the invention having a side pushbutton replacing the lever of the rolling lock mechanism.

As seen in FIGS. 28 and 29, a side pushbutton version provides a pushbutton 140 which operates a lever 143, thereby turning rolling lock 70. Referring to FIG. 18, the pushbutton 140 provides a rim 141 which is biased against the handle shell by a spring (not shown) while a button portion 144 protrudes. A doping contact 142 engages the lever 143, which drives the cylindrical body 72 of the rolling lock mechanism. By pushing the button portion 144 against the bias of the spring, the sloping portion 142 moves the lever 143, thereby rotating the cylinder 72, and unlocking the blade. Once the blade is unlocked, it can be rotated, which prevents the rolling lock from again assuming the locked position, until the blade is fully reopened.

Figure 30:
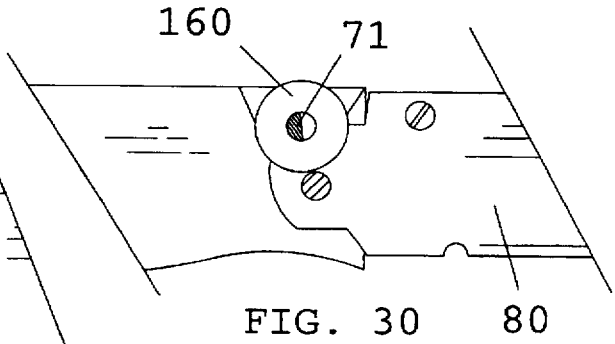
FIG. 30 is a side view of a version of the invention having a thumb wheel replacing the lever of the rolling lock mechanism.

Referring to FIG. 30, a thumb wheel 160 directly drives the cylindrical body 71, thereby allowing the user to lock and unlock the blade by operation of the thumb wheel.

Figure 31:
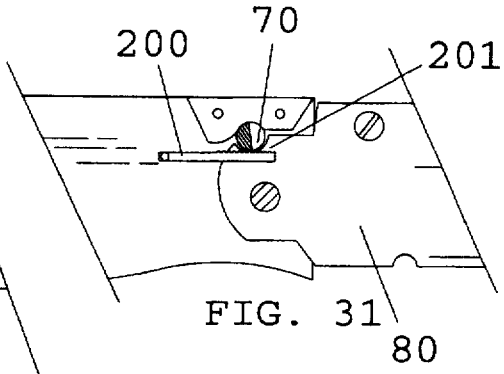
FIG. 31 is a side view of a rack and pinion apparatus replacing the lever of the rolling lock mechanism.

A rack and pinion may be used to drive the rolling lock mechanism. Referring to FIG. 31, a rack 200 having teeth 201 drives the cylindrical body 70. The rack may be forwardly directed, as is the pushbutton 120 seen in FIG. 26, or rearwardly directed as the pushbutton 180 seen in FIG. 27.

Figure 19:
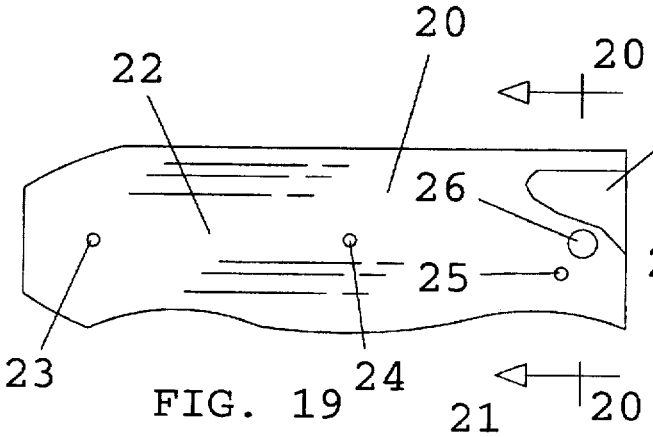
FIG. 19 is a side view of the inside surface of the left handle shell, showing the cavity in which the lever moves.
Figure 20:
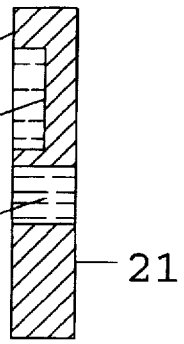
FIG. 20 is a cross-sectional view of the left handle shell of FIG. 19 along the 20—20 lines.
Figure 21:
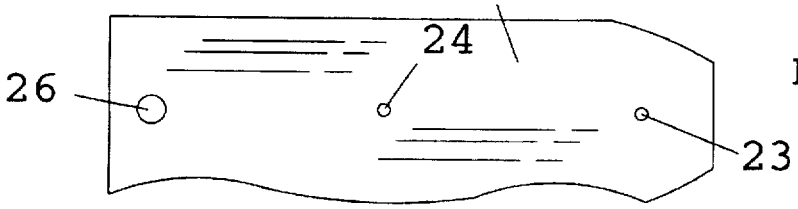
FIG. 21 is a side view of the outside surface of the left handle shell.

Referring to FIGS. 19–21, a version of the left handle shell 20 of the invention is seen. The handle shell provides a textured outside surface 21 and an inside surface 22. Rear and middle attachment bolt holes 23, 24 allow the handle shell to be attached to the knife mechanism by means of small bolts or other fastening means. A knife blade pivot hole 26 allows the pivot bolt 1 00 to be installed. A recessed surface 27 is adjacent to the inside surface 22, and creates a cavity between the left handle shell 20 and the left plate 41 of the knife mechanism, allowing the lever 75 of the rolling lock mechanism 70 to travel. That cavity is best seen in the cross-sectional view of FIG. 20.

Figure 22:
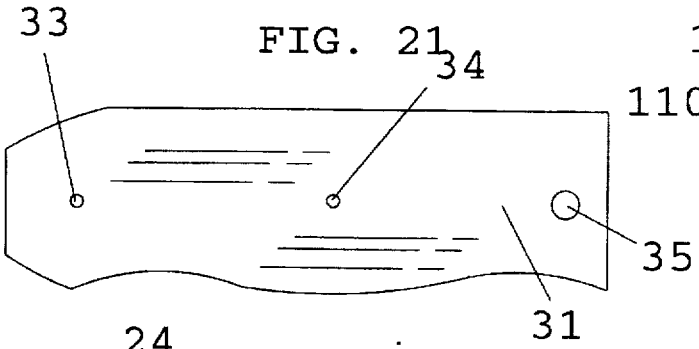
FIG. 22 is a side view of the outside surface of the right handle shell.
Figure 23:
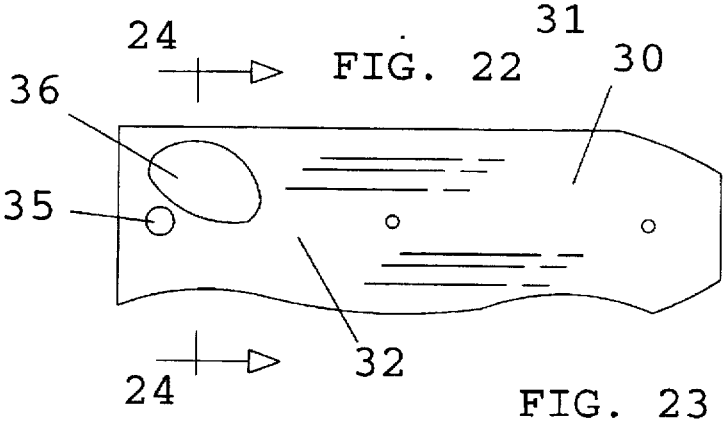
FIG. 23 is a side view of the inside surface of the right handle shell, showing the cavity occupied by the spring biasing the rolling lock.
Figure 24:
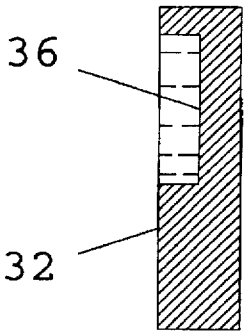
FIG. 24 is a cross-section of the right handle shell of FIG. 23 along the 24—24 lines.

Referring to FIGS. 22–24, a version of the right handle shell 30 of the invention is seen. The right handle shell provides a textured outside surface 31 and an inside surface 32. Rear and middle attachment bolt holes 33, 34 allow the handle shell to be attached to the knife mechanism by means of small bolts or other fastening means. A knife blade pivot hole 35 allows the pivot bolt 1 00 to be installed. A recessed surface 36 is adjacent to the inside surface 32, and creates a cavity between the right handle shell 30 and the right plate 43 of the knife mechanism, allowing for movement by the spiral spring 78. That cavity is best seen in the cross-sectional view of FIG. 24.

Figure 12:
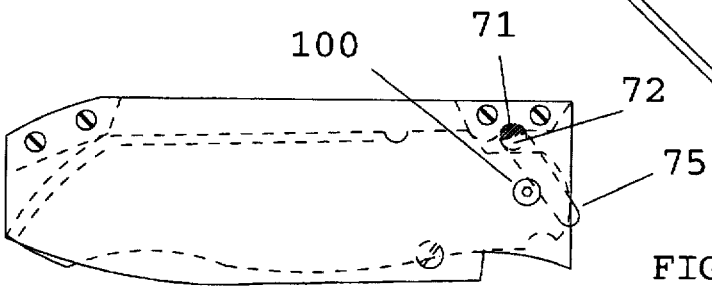
FIG. 12 is a view of the knife with the blade in the closed position.
Figure 25:
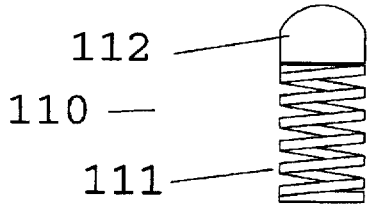
FIG. 25 is a side view of the spring and ball of the blade latch mechanism.

Referring to FIGS. 3, 19, and 25, a version of the blade latch mechanism 110 of the invention may be understood. A dimple 25 in the left handle shell 20 carries the detent spring 111 and ball 112 seen in FIG. 25. When the knife blade is in the closed position, as seen in FIG. 12, the ball 112 engages the dimple 89 in the base 85 of the blade 80. When in the closed position, gentle rotation of the blade compresses the detent spring 111, and disengages the ball 112 from the dimple 89 in the blade.

Referring in particular to FIGS. 9–12, the use of the rolling lock previously described can be understood. Beginning with the blade in the closed position, as seen in FIG. 12, and the rolling lock 70 in the open position, the user begins to open the blade. Detent spring 111 is compressed slightly, allowing the ball 112 to release the dimple 89 in the blade. The blade is then moved through the position seen in FIGS. 2 and 11, stopping when the rear edge 82 of the blade contacts the adjustment bolt 61. At this point, the spiral spring 78 rotates the rolling lock into the locked position, as seen in FIG. 1, thereby preventing the blade from being closed. As seen in FIG. 1, the cylindrical body is in a position wherein the notch of the cylindrical body is rotated away from the notch in the cam surface of the base of the blade, and whereby the cylindrical body occupies the space outlined by the notch in the blade, thereby preventing rotation of the blade about the pivot bolt.

Figure 9:
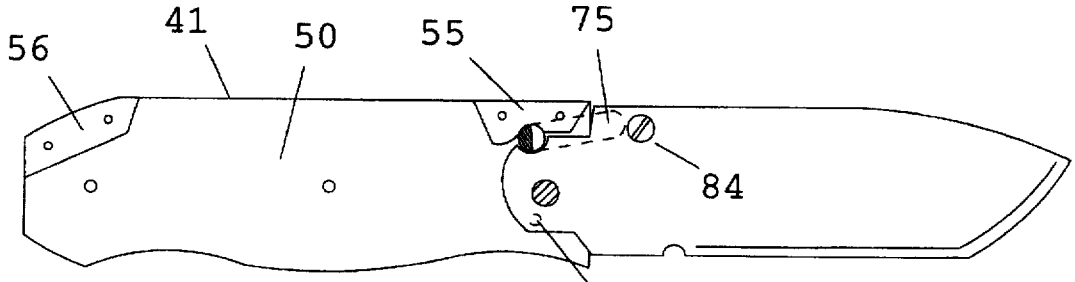
FIG. 9 is a side view of the knife of FIG. 1 showing the position of the rolling lock when the lock is in the locked position, and having the right side of the mechanism removed for clarity, and showing in dotted outline the blade latch mechanism hole in the left side of the knife mechanism.
Figure 10:
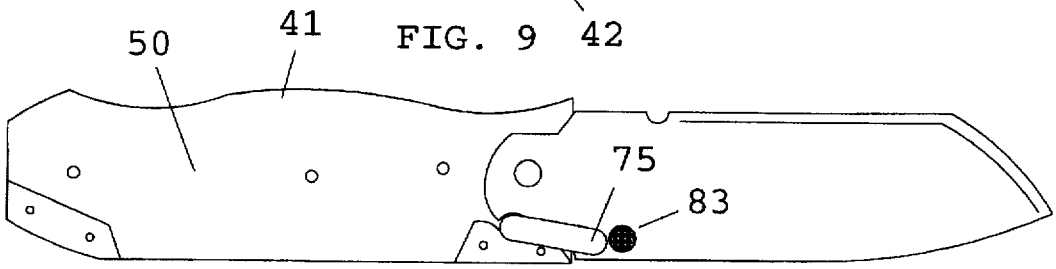
FIG. 10 is a view of the knife of FIG. 9, rotated 180 degrees, and having the left side of the mechanism removed.
Figure 11:
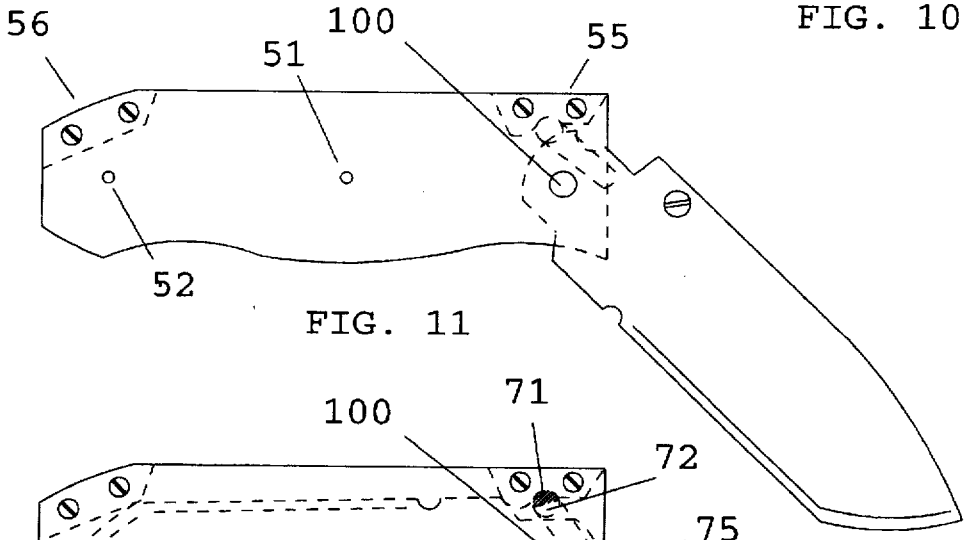
FIG. 11 is a view of the knife of FIG. 1 having the blade partially open and the lever of the rolling lock in a position indicating that the rolling lock is in the unlocked state.

To close the blade, the user moves the lever 75 of the rolling lock from the position seen in FIG. 9 to the position seen in FIGS. 11 and 12. The blade is then closed, causing ball 112 to engage the dimple 89 in the blade.

It is therefore a primary advantage of the present invention to provide a novel locking mechanism for a folding knife that is stronger than known locking mechanisms, and will therefore better protect the user against unintentional blade closure.

Another advantage of the present invention is to provide a novel locking mechanism for a folding knife that is easily operated.

A still further advantage of the present invention is to provide a locking mechanism for a folding knife that is lever operated, and therefore more easily operated that presently known locking mechanisms.

A still further advantage of the present invention is to provide a locking mechanism for a folding knife that is less costly to manufacture than presently known locking mechanisms.

Although the present invention has been described in considerable detail and with reference to certain preferred versions, other versions are possible. For example, while the knife mechanism has been described as having characteristics that are associated with either the left or right plates, it is clear that the characteristics of the plates could he reversed. For example, this would be the case of a custom knife designed for a left-handed person. Also, while the rolling lock of the invention has been disclosed as having a lever to rotate it between the locked and unlocked positions, it is clear that a thumb wheel or other type of rotating means could be used to rotate the rolling lock, and the lever thereby replaced. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A folding knife, comprising:

(a) a knife mechanism, comprising:

(a) a left plate having a pivot bolt hole carrying a blade pivot bolt, a hole for a rolling lock mechanism and a blade latch mechanism hole;

(b) a right plate having a pivot bolt hole carrying the blade pivot bolt, a hole for the rolling lock mechanism and a spring retainer hole; and (c) front and rear spacers, the front spacer having a half-round recess and a threaded adjustment hole, the spacers separating the left plate and the right plate;

(b) a blade, carried by the knife mechanism by means of the pivot bolt, the pivot bolt carried by the pivot bolt holes, comprising:

(a) a cutting edge;

(b) a rear edge; and (c) a base having a pivot bolt hole and a cam surface having a notch;

(c) adjustment bolt means, carried by the threaded adjustment hole, for regulating the exact degree to which the blade may be moved in an open position by making contact with the rear edge of the blade, thereby allowing a user to fine-tune the degree to which the blade may be rotated;

(d) the rolling lock mechanism, carried by the knife mechanism, comprising:

(a) a cylindrical body having a notch;

(b) a lever attached to the body;

(c) an end surface having a retainer slot; and (d) a spiral spring, carried by the retainer slot in the end surface and by the spring retainer hole of the right plate of the knife mechanism, biasing the cylindrical body to a position wherein the notch of the cylindrical body is rotated away from the notch in the cam surface of the base of the blade, whereby the cylindrical body occupies the space outlined by the notch in the blade and prevents rotation of the blade about the pivot bolt;

(e) a left handle shell, having a textured outside surface and an inside surface, attached to the left plate of the knife mechanism, the left handle shell having a rear attachment bolt hole, a middle attachment bolt hole and a knife blade pivot hole, additionally comprising:

(a) dimple means for carrying a blade latch mechanism; and (b) a recessed surface, adjacent to the inside surface, the recessed surface forming a cavity between the left handle shell and the knife mechanism adjacent to the lever of the rolling lock mechanism, whereby the lever may be moved by a user through the cavity formed;

(f) a right handle shell, having a textured outside surface and an inside surface, attached to the right plate of the knife mechanism, the right handle shell having a rear attachment bolt hole, a middle attachment bolt hole and a knife blade pivot hole, additionally comprising a recessed surface, adjacent to the inside surface, the recessed surface forming a cavity between the right handle shell and the knife mechanism adjacent to the end surface having the retainer slot of the rolling lock mechanism, whereby the spiral spring may be carried in the cavity formed; and (g) blade latch means for preventing the blade from opening in an unintended manner, comprising:

(a) a detent spring, carried by the dimple of the left handle shell;

(b) a ball having a flat side, the flat side contacted by the detent spring; and (c) a dimple in the base of the blade, sized to receive the ball, whereby contact between the dimple of the blade and the ball of the blade latch means provides a slight frictional resistance to the blade opening.

2. A folding knife, comprising:

(a) a knife mechanism;

(b) a blade, carried by the knife mechanism by means of a pivot bolt, having a base having a pivot bolt hole and a cam surface having a notch; and (c) a rolling lock mechanism, carried by the knife mechanism, comprising:

(a) a cylindrical body having means for engaging the notch in the cam surface of the blade; and (b) rotating means, attached to the cylindrical body, for rotating the cylindrical body with respect to the notch in the cam surface of the blade.

3. The folding knife of claim 2, wherein the rolling lock mechanism additionally comprises:

(a) lock biasing means for biasing the rolling lock mechanism into a locked position, wherein a notch of the cylindrical body is rotated away from the notch in the cam surface of the base of the blade, whereby the cylindrical body occupies a space outlined by the notch in the blade, thereby preventing rotation of the blade about the pivot bolt;

(b) first attachment means, carried by the rolling lock mechanism, for attaching the lock biasing means to the rolling lock mechanism;

(c) second attachment means, carried by the knife mechanism, for attaching the lock biasing means to the knife mechanism.

4. The folding knife of claim 3, wherein the lock biasing means comprises a spiral spring, and wherein the first attachment means comprises a slot in an end surface of the rolling lock mechanism and an annular groove in the rolling lock mechanism, and wherein the second attachment means comprises a spring retainer hole in the knife mechanism.

5. The folding knife of claim 4, further comprising:

(a) a left handle shell, having an outside surface and an inside surface, attached to a left plate of the knife mechanism, the left handle shell having at least one attachment belt hole and a knife blade pivot hole, additionally comprising a recessed surface, adjacent to the inside surface, the recessed surface forming a cavity between the left handle shell and the knife mechanism adjacent to the rolling lock mechanism, whereby the rotating means of the rolling lock mechanism may be moved by a user within the cavity formed; and (b) a right handle shell, having a textured outside surface and an inside surface, attached to a right plate of the knife mechanism, having at least one attachment belt hole and a knife blade pivot hole, additionally comprising a recessed surface, adjacent to the inside surface, the recessed surface forming a cavity between the right handle shell and the knife mechanism adjacent to the rolling lock mechanism, whereby the lock biasing means may be carried in the cavity formed.

6. The folding knife of claim 5, further comprising blade latch means for preventing the blade from opening in an unintended manner.

7. The folding knife of claim 6, wherein the blade latch means comprises:

(a) a detent spring, carried by a dimple in the left handle shell;

(b) a ball carried by the detent spring; and (c) a dimple in the base of the blade, sized to receive the ball, whereby contact between the dimple of the blade and the ball of the latch means provides a slight frictional resistance to the blade opening.

* * * * *